United States Patent [19]

Foster et al.

[11] Patent Number: 4,684,043

[45] Date of Patent: Aug. 4, 1987

[54] SHIPPING SEAL FOR VISCOUS PRODUCT DISPENSER

[75] Inventors: Donald D. Foster, Lee's Summit; Robert N. Hills, Raytown, both of Mo.

[73] Assignee: Realex Corporation, Kansas City, Mo.

[21] Appl. No.: 653,297

[22] Filed: Sep. 24, 1984

[51] Int. Cl.[4] ..... B67D 5/42

[52] U.S. Cl. ..... 222/386; 222/400.5; 222/401; 222/512; 222/541; 222/542; 222/560; 222/257

[58] Field of Search ..... 222/391, 387, 257, 259, 222/260, 153, 541, 560, 556, 562, 319, 320, 400.5, 401, 402, 517, 386, 512, 542; 215/232, 344; 220/359, 256, 258, 259

[56] References Cited

U.S. PATENT DOCUMENTS

| | | | |
|---|---|---|---|
| 2,776,787 | 1/1957 | Nicol | 220/359 X |
| 2,932,436 | 4/1960 | Dobbins | 222/541 |
| 3,889,844 | 6/1975 | Viker et al. | 222/541 X |
| 4,140,241 | 2/1979 | Erlandson | 222/541 X |
| 4,154,371 | 5/1979 | Kolaczinski | 222/386 X |
| 4,394,939 | 7/1983 | Thor et al. | 222/517 X |
| 4,402,431 | 9/1983 | Wiegner et al. | 222/260 X |
| 4,444,340 | 4/1984 | Bond et al. | 222/517 X |
| 4,501,371 | 2/1985 | Smalley | 220/258 X |
| 4,511,068 | 4/1985 | Bossina | 222/387 X |

FOREIGN PATENT DOCUMENTS

| | | | |
|---|---|---|---|
| 0084638 | 8/1983 | European Pat. Off. | 222/391 |
| 3104726 | 8/1982 | Fed. Rep. of Germany | 222/386 |

OTHER PUBLICATIONS

U.S. patent application Ser. No. 06/565,540; filed Dec. 27, 1983; Ford et al.

U.S. patent application Ser. No. 06/589,640; filed Mar. 14, 1984; Foster.

*Primary Examiner*—Joseph J. Rolla

*Assistant Examiner*—David H. Bollinger

*Attorney, Agent, or Firm*—Schmidt, Johnson, Hovey & Williams

[57] ABSTRACT

The actuating lever of the dispenser has an integral valve flap which covers the discharge outlet of the dispenser when the lever is in its standby position, and in order to augment the sealing capabilities of such flap during shipment or storage prior to customer acquisition and use of the dispenser, a disposable sealing tape is provided which is factory-installed so as to overlie the outlet between the latter and the covering valve flap. The tape is provided with a layer of adhesive to promote retention of the tape in sealing relationship with the outlet, and a tab portion of the tape extends from the outlet and is adhered to adjacent portions of the dispenser in such a manner as to facilitate grasping and removal by the user. An overcap enclosing the otherwise exposed actuating lever and discharge spout has internal structure depending from a top wall thereof which bears resiliently against the actuator flap to press the latter tightly against the tape and promote retention thereof in covering relationship to the outlet.

6 Claims, 5 Drawing Figures

-36-

SHIPPING SEAL FOR VISCOUS PRODUCT DISPENSER

TECHNICAL FIELD

This invention relates to the field of manually-operated pumping dispensers having particular utility for viscous products such as toothpaste and the like.

BACKGROUND

Prior co-pending applications Ser. No. 06/565,540, filed Dec. 27, 1983, and Ser. No. 06/589,640 filed Mar. 14, 1984, now abandoned, both assigned to the assignee herein, disclose a viscous product dispenser utilizing a free-floating take-up piston which automatically responds to the discharge of a volume of product from the dispenser by moving under the influence of atmospheric pressure to "take-up" the space in the chamber left vacant by the discharged product. It has been found that in isolated circumstances during shipment or other handling of the dispenser, a sharp blow to the dispenser may result in the take-up piston inching forwardly in the product chamber by a small increment, nothwithstanding the fact that the actuating lever has not been depressed. Because the take-up piston is provided with one-way retaining structure which prevents it from moving in a reverse direction, once the take-up piston has been jarred forwardly, it applies an additional loading pressure to the contents and encourages at least a minimal amount of seepage from the discharge spout of the dispenser. This can occur to a certain extent even though the actuating lever as disclosed in such prior applications is provided with a shutoff valve flap integral therewith that covers the outlet of the spout during periods of nonuse.

SUMMARY OF THE PRESENT INVENTION

Accordingly, an important object of the present invention is to provide a temporary shipping seal for dispensers of the aforementioned type which is in the form of non-porous sealing tape or the like applied over the discharge outlet and under the valve flap so as to utilize the presence of the flap as a aid in retaining the seal tightly against the outlet in covering relationship thereto. Prior to first actuation of the dispenser, the seal tape may be readily pulled from the dispenser and discarded, placing the dispenser in immediate condition for actuation.

Preferably, an overcap for the actuating lever and dispensing spout of the unit is provided with a depending skirt on its top wall which is so disposed that it engages and bears yieldably against the flap when the overcap is in position and secured down on the dispenser body. The skirt flares out as it bears against the flap and applies an additional or augmenting retaining force to the flap which helps resist accidental, premature removal of the seal and counteracts internal pressure of the product which may have built up against the underside of the seal.

DETAILED DESCRIPTION

Figures 1, 2, 3, 4, 5:
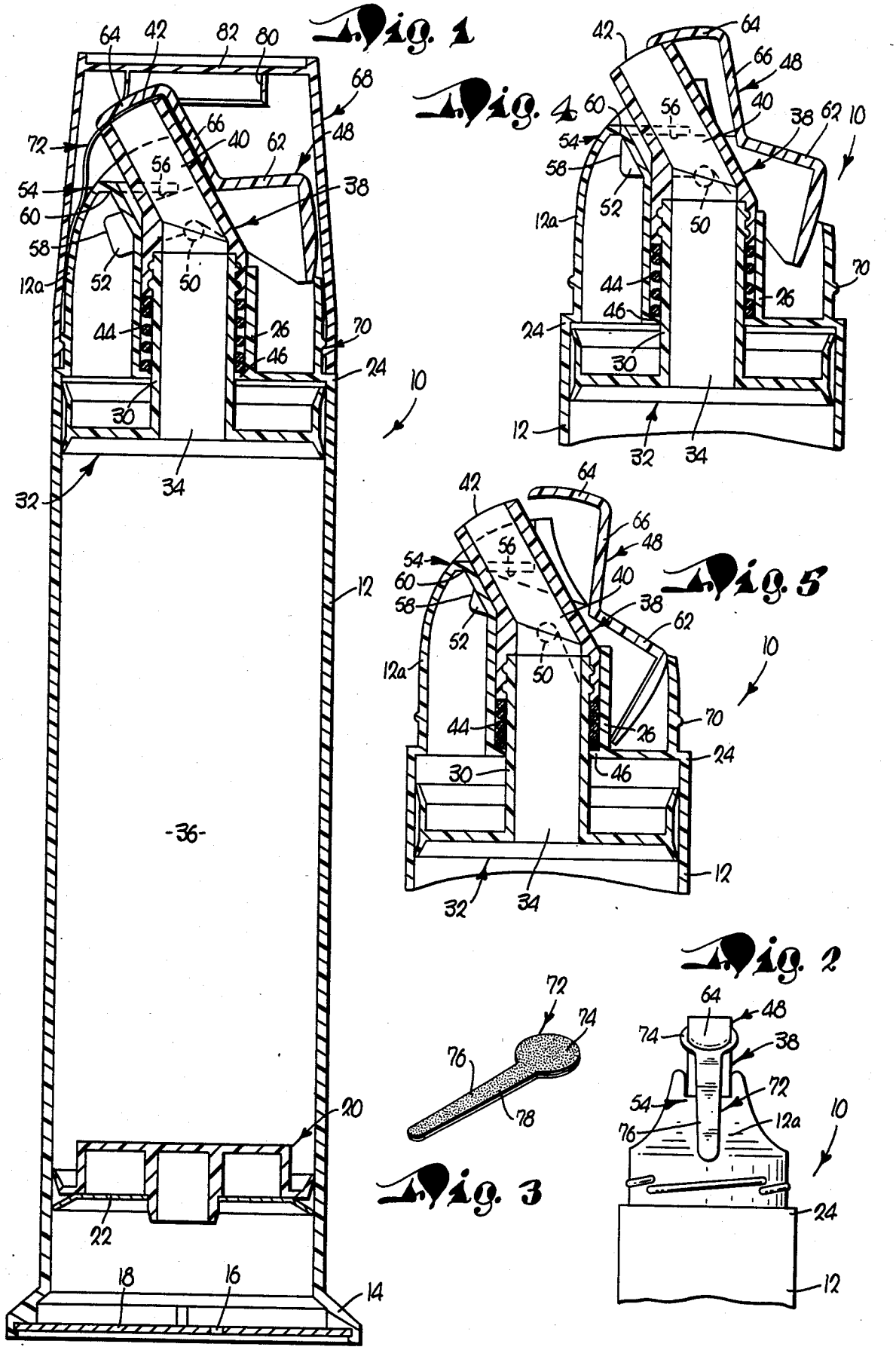
FIG. 1 is a vertical cross-sectional view of a dispenser constructed in accordance with the principles of the present invention illustrating a a sealing tape installed thereon.
FIG. 2 is a fragmentary elevational view thereof with the overcap removed and the dispenser rotated 90 degrees from its FIG. 1 position.
FIG. 3 is an enlarged isometric view of the sealing tape.
FIG. 4 is fragmentary vertical cross-sectional view of the dispenser with the sealing tape removed and the actuating lever illustrated at the end of its lost-motion travel during actuation.
FIG. 5 is a fragmentary vertical cross-sectional view of the dispenser similar to FIG. 4 but illustrating the actuating lever in a fully depressed position.

The dispenser 10 includes a tubular, cylindrical body 12 which is open at its lower end 14 to the atmosphere via an aperture 16 in a decorative closure panel 18 or the like which spans the lower end 14. A floating piston 20 makes sealing engagement with the interior wall surface of the body 12 and has a downwardly and outwardly flaring metal skirt 22 or the like on the bottom thereof which likewise engages the interior surface of body 12. The skirt 22 is sufficiently resilient that it will deflect downwardly to any extent necessary to permit the piston 20 to rise in the body 12 yet is at the same time sufficiently stiff as to bite into the wall surface during attempted downward movement of the piston 20 within body 12, thereby preventing such retrograde movement.

The opposite end 24 of the body 12 includes an upright, centrally disposed sleeve 26 supported by transversely extending web means 28. The sleeve 26 reciprocably receives the tubular stem 30 of a pumping piston 32 which at its circumferential periphery sealingly engages the inner wall surface of the body 12. A passage 34 is defined within the tubular stem 30, and the two pistons 20 and 32 cooperate with the body 12 to form a pumping chamber 36 therebetween.

The sleeve 26 also partially receives the lower end of a tubular discharge spout 38 which itself receives the upper end of the plunger stem 30 and is securely attached thereto. A passage 40 is defined within the spout 38, and a discharge outlet 42 is presented at the uppermost end thereof. A coil spring 44 encircles the piston stem 30 and is trapped between the lower extremity of the spout 38 and a lower, in-turned terminus 46 of the sleeve 26 for the purpose of yieldably biasing the piston 32 and the spout 38 toward an upper, undepressed position as illustrated in FIG. 1.

The dispenser 10 is also provided with an actuator unit broadly denoted by the numeral 48 pivotally mounted on a fulcrum 50 on the spout 38. The fulcrum 50 takes the form of a pair of pins projecting laterally from opposite sides of the spout 38, and a pair of legs 52 of the actuator unit 48 (only one leg 52 being illustrated) straddle the spout 38 and rest at their midpoints upon the respective fulcrum pins 50.

The legs 52 project forwardly at such an angle and to such an extent that they underlie respective ledges 54 on the body 12 adjacent the spout 38. Each of such ledges 54 has a first bottom surface 56 at the outermost extremity thereof which abuttingly engages the opposite side of the proximal leg 52 from the corresponding fulcrum pin 50 when the actuator 48 is in the standby position of FIG. 1, thus cooperating with the fulcrum pins 50 to trap the leg 52 therebetween. Spring pressure from the spring 44 assists in this regard, and the geometry is such that the actuator 48 tends to remain up in its FIG. 1 position with the legs 52 projecting downwardly and forwardly so that their outermost ends 58 are spaced below a second bottom surface 60 on each of the ledges 54 spaced inwardly from the terminal edge surface 56 thereof.

The actuator 48 includes a finger-engaging portion 62 on one side of the fulcrum pins 50 and a valve flap member 64 on the opposite side thereof. The flap member 64 is integrally joined with the finger-engaging portion 62 by an intermediate web portion 66, the flap member 64 being of such dimension as to completely cover and thus close the outlet 42 when the actuator 48 is in its FIG. 1 position.

The outermost surface extremity of the spout 38 at the outlet 42 is transversely arcuate, having a center or axis coinciding with the fulcrum pins 50. Likewise, the valve flap 64 itself, particularly the underside thereof, is transversely arcuate in complemental relationship with the arcuate surface of the outlet 42. Thus, the exposed surface of the outlet 42, the undersurface of the valve flap 64, and the axis of pivoting movement of the actuator unit 48 all have centers or axes which coincide with one another at the fulcrum pins 50. Preferably, the valve flap 64 is so positioned that its undersurface lightly contacts the outwardly facing surface of the outlet 42 when the actuator 48 is in its FIG. 1 position.

If desired, the dispenser 10 may be provided with an overcap 68 which threads down onto the body 12 via intermeshing threads 70 at the base of the overcap 68.

A shipping seal broadly denoted by the numeral 72 comprises an elongated element of relatively thin, flexible, non-porous material such as vinyl and is provided with a generally circular head 74 and an extended, slender pull tab or tail 76. The head 74 is at least as large in diameter as the outlet 42, and the entire length of the seal 72 is provided with a suitable contact adhesive layer 78.

OPERATION

At the factory, and with the actuating lever 48 fully depressed as illustrated in FIG. 5, the shipping seal 72 may be readily applied in such a way that the head 74 thereof completely covers the outlet 42, with the adhesive 78 adhering to the engaged outer edge of the spout 38 at outlet 42. The tail 76 may be conveniently pressed against the upper housing portion 12*a* of the body 12 adjacent the spout 38 so that the adhesive 78 firmly, yet removably, attaches the tail 76 in place. Release of the actuating lever 48 then permits the flap member 64 thereof to swing back across the outlet 42 outside of the seal 72 so that the head 74 is confined between the flap member 64 on the one hand and the outlet 42 on the other. Preferably, the closeness of fit between the flap member 64 and the outlet 42 is such that the member 64 actually applies a degree of compressive or clamping pressure to the seal head 74.

When the dispenser is filled with product and the overcap 68 is threaded onto the body 12, a depending, resilient skirt 80 on a top wall 82 of the overcap 68 approaches the member 64 at an acute angle and comes into progressively more forceful, contacting engagement with the upper surface thereof as illustrated in FIG. 1. While the various walls of the overcap 68 are of a certain thickness, the skirt 80 is of a lesser thickness whereby to provide the desired degree of resiliency. In this respect, it is necessary and desirable that the skirt 80 be sufficiently stiff as to be capable of applying compressive force to the seal 72 through the flap member 64 so as to provide an auxiliary retaining force in that respect, yet be sufficiently resilient as to accommodate tolerance build ups and dimensional variations which might be caused during manufacturing of the dispenser. In this respect, it is contemplated that most of the components of the dispenser will be molded out of a suitable synthetic resinous material which, by nature, undergoes a cetain amount of shrinkage and dimensional variation during manufacture. Preferably, the lowermost extremity of the skirt 80 is provided with a bevel which is at least approximately comparable to the slope on the outer face of the flap member 64 such that the skirt 80, by this construction, is further encouraged to flare outwardly under stress as illustrated in FIG. 1.

In order to prepare the dispenser for operation, the overcap 68 is first removed by simply pulling the same with sufficient force as to overcome the frictional interengagement between the snap beads 70. Thereupon, a slight actuation of the actuating lever 48 to the position illustrated in FIG. 4 permits the flap member 64 to uncover the outlet 42 sufficiently as to permit the tail 76 of seal 72 to be stripped from surface 12*a*, pulling the head 74 along, and thus completely removing seal 72. As will be explained below, depression of the lever 48 only to the FIG. 4 position thereof does not result in pumping any product out of the spout 38 since the lever 48 has a degree of lost motion. Once the seal 72 has been stripped from the dispenser, it may simply be discarded.

With respect to the details of operation of the dispenser, it will be appreciated that the return spring 44 normally maintains the pumping piston 32, the spout 38 and the actuator 48 in the position of FIG. 1 in which the flap member 64 tightly covers, closes off and thus seals the outlet 42. After removal of the overcap 68, application of downwardly directed finger pressure to the finger-engaging portion 62 of the actuator 48 will cause the latter to rock downwardly about the fulcrum pins 50 in a clockwise direction, sliding the flap member 64 off the outlet 42 in the same direction until the condition as illustrated in FIG. 4 is reached. During such initial lost-motion movement, the upper edge surfaces 56 of the ledge 54 remain in engagement with the corresponding legs 58, and the point of contact of the legs 58 with such surfaces 56 is moved slightly along the legs 52 toward the outer ends 58 thereof. There is also a very slight, miniscule amount of downward movement of the spout 38 during this timeframe since the distance between the fulcrum pins 50 and the surfaces 56 of ledges 54 is increased slightly at this time to permit the outermost ends of the legs 52 to swing upwardly into abutting engagement with the second surfaces 60 of the ledges 54.

As it will be clearly seen in FIG. 4, by the time the outer ends 58 of the legs 52 have swung up to and engaged the second surfaces 60, the outlet 42 is substantially entirely opened by the valve flap 64. Yet, no substantial pumping motion of the pumping piston 32 has occurred.

As depression of the finger-engaging portion 62 then continues, the outer ends 58 of the legs 52 fulcrum against the surfaces 60 as the actuator unit 48 changes its fulcrum point from the pins 50 to the points of engagement of the legs 52 with surfaces 60 of the ledges 54. During such time, the pumping piston 32 becomes depressed and the legs 52 move away from the first surfaces 56 until the condition of FIG. 5 is reached, at which time a full pumping stroke has been completed in one direction.

Thereafter, releasing finger pressure on the portion 62 allows the spring 44 to raise the pumping piston 32 and the spout 38 back toward the FIG. 1 position thereof, while at the same time rotating the actuator 48 in a counterclockwise direction. By the time the actuator 48 reaches the position illustrated in FIG. 4, the flap member 64 will just begin to slide back over the outlet 42. At this time there will be a sufficient amount of spring movement left in the spring 44 to continue to urge the actuator 48 counter-clockwise in a lost-motion action as the piston 32 substantially comes to a halt.

As the valve flap 64 then slides downwardly across the open end of the outlet 42, it slices through the bead of product extending from the spout 34 and severs the same in the nature of a guillotine from the product left behind. By the time valve flap 64 is fully returned into covering relationship with the outlet 42, the bead of product has been completely disconnected from that remaining within the spout 38 in a neat, clean, and visually pleasing manner, leaving no clinging unsightly residue of any consequence in and around the outlet 42.

In view of the evacuation of product within the chamber 36 and the closing of the outlet 42 by valve flap 64, the floating piston 20 is moved upwardly within the chamber 36 by a corresponding amount as atmospheric pressure is applied against the bottom of the piston 20 via the aperature 16 in the aesthetic end cover 18. In this respect, it will be appreciated that, depending on the nature of the product being dispensed, the valve flap 64 serves in the capacity of a check valve to prevent significant retrograde movement of product back through the spout 38 in an effort to replenish that portion of the chamber 36 which has been evacuated during the immediately preceding pumping stroke. Consequently, the piston 20 is enabled to float upwardly within the chamber 36 in the proper manner to decrease the effective volume of the chamber 36 by the amount of discharged product.

It will be appreciated that only a single embodiment of the present invention has been disclosed herein. However, various obvious modifications to the disclosed embodiment will be apparent to those skilled in the art without departing from the spirit and underlying principles of this invention. Thus, the scope of the present invention should be deemed to include any such obvious modifications and be limited only by a fair interpretation of the claims which follow.

We claim:

1. In a viscous product pump dispenser having a discharge outlet covered by a valve member of the actuator of the pump during periods of non-use of the dispenser, the improvement comprising:

a disposable shipping seal in combination with the member for preventing unintentional discharge of product from the dispenser prior to the first intentional actuation thereof, said seal comprising a relatively thin, flat, flexible, non-porous element removably covering said outlet between the latter and said valve member of the actuator, said element including a manually accessible pull-tab portion projecting beyond said member when the latter is covering the outlet, said element being flat throughout its entire extent and spanning said outlet without projecting into the same whereby to avoid retention of the element by the inside of the spout in the event the element is pulled lengthwise out from under the member to prepare the dispenser for operation, said dispenser further including a main body and an overcap detachably secured to the body in enclosing relationship to said member, said seal and said outlet, said overcap having structure disposed to yieldably engage said member when the latter is covering said outlet for pressing the member against the element, said overcap being provided with a top wall normally disposed above said member and a continuous, annular sidewall depending from the periphery of said top wall, said structure comprising a resilient skirt spaced inwardly from the sidewall and depending from said top wall to press downwardly against the member from above the latter.

2. In a despenser as claimed in claim 1, wherein said element is provided with an adhesive layer on one side thereof for detachably securing the element to the outlet.

3. In a dispenser as claimed in claim 2, wherein said pull-tab portion is adapted to detachably adhere to a surface of the dispenser adjacent said outlet.

4. A viscous product dispenser comprising:

a tubular body having a reciprocable pumping piston at one end thereof provided with a passage through which product may flow during discharge from the body, and a take-up piston initially at the opposite end thereof for progressively advancing toward said one end in order to take up space in the body vacated by product discharged therefrom, said take-up piston having anti-retrograde means associated therewith preventing movement of the take-up piston in a direction away from said pumping piston;

a product discharge spout secured to said pumping piston for movement therewith and communicating with said passage for receiving product therefrom during a pumping stroke of said pumping piston;

an actuator operably coupled with said pumping piston for shifting the latter in said pumping stroke thereof, said actuator including an external valve member as an integral component thereof which is adapted to cover and thereby close an outlet of the spout when the actuator is in a standby position thereof and to uncover and thereby open said outlet when the actuator is in an operated position thereof;

means for yieldably biasing the actuator toward said standby position; and a disposable shipping seal including a relatively thin, flat, flexible, non-porous element removably covering said outlet between the latter and said member when the actuator is in said standby position, said element including a manually-accessible pull-tab portion projecting beyond the member when the latter is covering the outlet, said element being flat throughout its entire extent and spanning said outlet without projecting into the same whereby to avoid retention of the element by the inside of the spout in the event the element is pulled lengthwise out from under the member to prepare the dispenser for operation, said dispenser including an overcap detachably secured to the body in covering relationship to the spout and the actuator, said overcap having structure yieldably engaging said member to assist in maintaining the actuator in said standby position and the element pressed against the outlet, said overcap being provided with a top wall normally disposed above said member and a continuous, annular sidewall depending from the periphery of said top wall, said structure comprising a resilient skirt spaced inwardly from the sidewall and depending from said top wall to press downwardly against the member from above the latter.

5. A dispenser as claimed in claim 4, wherein said element is provided with an adhesive layer on one side thereof for detachably securing the element to the outlet.

6. In a dispenser as claimed in claim 5, wherein said pull-tab portion is adapted to detachably adhere to a surface of the dispenser adjacent said outlet.

* * * * *